US009133663B2

(12) United States Patent
Klish et al.

(10) Patent No.: US 9,133,663 B2
(45) Date of Patent: Sep. 15, 2015

(54) FIRE AND SMOKE RATED FABRIC DOOR

(71) Applicant: CIW Enterprises, Inc., Mountaintop, PA (US)

(72) Inventors: Ian Klish, Nanticoke, PA (US); Joseph D. Kondash, Wilkes-Barre, PA (US); Joseph L. Balay, Sugarloaf, PA (US); Thomas Balay, Drums, PA (US)

(73) Assignee: CIW Enterprises, Inc., Mountaintop, PA (US)

( * ) Notice: Subject to any disclaimer, the term of this patent is extended or adjusted under 35 U.S.C. 154(b) by 134 days.

(21) Appl. No.: 13/864,433

(22) Filed: Apr. 17, 2013

(65) Prior Publication Data

US 2013/0228289 A1 Sep. 5, 2013

Related U.S. Application Data

(63) Continuation-in-part of application No. 13/034,096, filed on Feb. 24, 2011, now Pat. No. 8,651,164.

(60) Provisional application No. 61/640,878, filed on May 1, 2012.

(51) Int. Cl.

| | |
|---|---|
| ***E05F 15/20*** | (2006.01) |
| ***E06B 9/82*** | (2006.01) |
| ***E06B 9/68*** | (2006.01) |
| ***A62C 2/10*** | (2006.01) |
| ***A62C 2/24*** | (2006.01) |
| *A62C 2/22* | (2006.01) |

(52) U.S. Cl.

CPC ... *E06B 9/82* (2013.01); *A62C 2/10* (2013.01); *A62C 2/247* (2013.01); *E06B 9/68* (2013.01); *A62C 2/22* (2013.01)

(58) Field of Classification Search

CPC ..... E05Y 2201/41; E05Y 2900/134; A62C 2/10; E06B 9/82

USPC ..... 160/7–9, 310, 1, 300, 301, 405

See application file for complete search history.

(56) References Cited

U.S. PATENT DOCUMENTS

| | | | | | |
|---|---|---|---|---|---|
| 1,275,168 | A | * | 8/1918 | McCloud | 160/8 |
| 1,332,942 | A | * | 3/1920 | Brunst | 160/8 |
| 2,038,523 | A | * | 4/1936 | Cahill | 160/7 |
| 3,685,567 | A | * | 8/1972 | Pemberton et al. | 160/8 |
| 3,755,968 | A | * | 9/1973 | Williams | 49/489.1 |
| 4,130,156 | A | * | 12/1978 | Wardlaw | 160/9 |
| 4,147,197 | A | * | 4/1979 | Bailey et al. | 160/7 |
| 4,379,481 | A | * | 4/1983 | Juner et al. | 160/310 |
| 4,386,398 | A | * | 5/1983 | Matsuoka et al. | 700/90 |
| 5,134,347 | A | * | 7/1992 | Koleda | 318/16 |
| 5,203,392 | A | * | 4/1993 | Shea | 160/7 |
| 5,228,492 | A | * | 7/1993 | Jou | 160/188 |
| 5,253,693 | A | * | 10/1993 | Marlatt et al. | 160/7 |
| 5,357,183 | A | * | 10/1994 | Lin | 318/468 |

(Continued)

*Primary Examiner* — Katherine Mitchell
*Assistant Examiner* — Johnnie A Shablack
(74) *Attorney, Agent, or Firm* — Mitchell A. Smolow

(57) ABSTRACT

A vertically coiling door assembly that is used for emergency egress. Upon notice of a predefined alarm state, after a delay the door deploys by gravity, stopping upon contact with an obstruction. The door may be lifted at any time without power and after a set amount of lift powered movement is triggered moving the door to a preset height, pausing the door at that height, and then resuming gravity deployment. In the total absence of power the door may still be lifted, with resumption of gravity deployment upon removal of the lifting force.

21 Claims, 6 Drawing Sheets

(56) References Cited

U.S. PATENT DOCUMENTS

| | | | | | |
|---|---|---|---|---|---|
| 5,467,559 | A * | 11/1995 | Owens | 49/321 |
| 5,576,581 | A * | 11/1996 | Iannuzzi et al. | 307/117 |
| 5,850,865 | A * | 12/1998 | Hsieh | 160/310 |
| 5,896,907 | A * | 4/1999 | Dever et al. | 160/6 |
| 5,969,637 | A * | 10/1999 | Doppelt et al. | 340/12.55 |
| 6,014,307 | A * | 1/2000 | Crimmins | 361/170 |
| 6,065,525 | A | 5/2000 | Wells | |
| 6,155,324 | A * | 12/2000 | Elliott et al. | 160/1 |
| 6,484,784 | B1 * | 11/2002 | Weik et al. | 160/7 |
| 7,138,912 | B2 * | 11/2006 | Fitzgibbon et al. | 340/521 |
| 7,299,847 | B1 * | 11/2007 | Evans | 160/1 |
| 7,343,958 | B1 * | 3/2008 | East et al. | 160/191 |
| 7,591,102 | B1 * | 9/2009 | Evans | 49/7 |
| 7,878,230 | B2 * | 2/2011 | Daus et al. | 160/9 |
| 8,037,922 | B2 * | 10/2011 | Hawkins et al. | 160/310 |
| 8,069,896 | B2 * | 12/2011 | Magro | 160/1 |
| 8,091,604 | B2 * | 1/2012 | Kluck | 160/1 |
| 8,397,787 | B1 * | 3/2013 | Daus et al. | 160/9 |
| 8,651,164 | B2 * | 2/2014 | Klish et al. | 160/7 |
| 8,806,806 | B2 * | 8/2014 | Leivenzon et al. | 49/140 |
| 8,907,608 | B2 * | 12/2014 | Krupke et al. | 318/471 |
| 2008/0250716 | A1 * | 10/2008 | Ranaudo et al. | 49/31 |
| 2010/0115853 | A1 * | 5/2010 | Gebhart et al. | 49/506 |
| 2010/0242364 | A1 * | 9/2010 | Magro | 49/31 |
| 2010/0243175 | A1 | 9/2010 | Gonzales et al. | |
| 2011/0282496 | A1 * | 11/2011 | Hsu | 700/275 |
| 2012/0297684 | A1 * | 11/2012 | Bresson et al. | 49/360 |
| 2013/0042530 | A1 * | 2/2013 | Leivenzon et al. | 49/26 |
| 2014/0246154 | A1 * | 9/2014 | Dawdy | 160/7 |
| 2014/0305599 | A1 * | 10/2014 | Pimenov | 160/7 |
| 2014/0305600 | A1 * | 10/2014 | Casey et al. | 160/127 |
| 2014/0318719 | A1 * | 10/2014 | Hsieh | 160/133 |
| 2014/0345812 | A1 * | 11/2014 | Casey et al. | 160/273.1 |

* cited by examiner

FIRE AND SMOKE RATED FABRIC DOOR

CROSS REFERENCE TO RELATED APPLICATIONS

This application claims benefit of U.S. Provisional Application No. 61/640,878 filed May 1, 2012 and is a continuation-in-part of U.S. application Ser. No. 13/034,096 filed Feb. 24, 2011.

FIELD OF THE INVENTION

This invention relates generally to emergency egress, and in particular, to a vertical acting emergency egress with simultaneous fire/smoke barrier protection using a fabric door.

BACKGROUND OF THE INVENTION

By code, buildings such as industrial, school and public buildings require fire and smoke barrier opening protectives. They also require emergency egress capability. Due to the simplistic operation and known designs of swing door exit hardware, side-hinged swinging doors are commonly used to simultaneously accomplish both.

However, code rated side-hinged swinging doors are not always the desired design choice to meet code requirements. For structures needing higher occupancy load egress and fire/smoke protection requirements, multiple swing doors and/or banks of swing doors and their associated frame assemblies are used. The framing requirements of multiple doors and/or banks of doors present architectural challenges for building designers.

In an attempt to overcome these challenges, a variety of door designs have been developed. One known design uses up to two swinging fire door and frame assemblies that store in pockets perpendicular to the opening. A second known design includes a bank of swinging fire door and frame assemblies that are attached to the bottom of a coiling door. Although these designs include commonly accepted side-hinge swinging doors, they require significantly more head or side room clearances and cost more to manufacture than earlier designs.

Another known design uses commonly accepted side-hinge swinging doors in an accordion folding fire door configuration. However, this design requires side stack space for the folded accordion door and non-folding side-hinge swinging door(s). Because occupancy load determines the amount of door opening/number of required doors, each required side-hinge swinging door mandates additional side stack space, thereby reducing the overall free space and presenting construction challenges.

Another known design uses accordion folding fire doors with an integral DC power supply and curtain mounted egress activation hardware that causes electric opening of the door for egress. The speed of clearing the opening must be coordinated with the building occupant load and required egress opening width within 10 seconds of egress hardware activation. These doors mandate ample side room to store the accordion folding fire door and operating system Accordingly, there remains a continuing need for improved combined emergency egress and fire/smoke barrier designs. The present invention fulfills this need and further provides related advantages.

BRIEF SUMMARY OF THE INVENTION

The fire and smoke rated fabric door described below presents a novel alternative to side-hinged swinging doors and offers access to an egress opening width needed to meet occupancy egress requirements while simultaneously qualifying as a fire/smoke barrier.

A vertically coiling fabric door assembly is used for smoke and fire protection for vertical openings in, for example, elevator hoistway door and frame assemblies, elevator lobbies and at the intersection of the elevator lobby and fire rated or non-fire rated corridors.

Intended uses include, for example, compliance with the 2012, 2009 and 2006 *International Building Code*® (IBC), NFPA 80, NFPA 72, NFPA 101, NFPA 105, and The 2012, 2009 and 2006 International Fire Code, all incorporated by reference.

For example, the fabric fire door can be used as an alternative to the requirement for an enclosed elevator lobby in accordance with Exception 3 of 2012 IBC Section 713.14.1, 2009 IBC Section 708.14.1 and 2006 IBC Section 707.14.1, all incorporated by reference, when installed over elevator openings equipped with a fire rated elevator hoistway door and frame assembly.

The fabric fire door may also be used as an alternative to the requirement for an enclosed elevator lobby in accordance with Exception 5 of 2012 IBC Section 713.14.1, 2009 IBC Section 708.14.1 and 2006 IBC Section 707.14.1, all incorporated by reference, when installed remotely from elevator openings at the intersection of the elevator lobby and a non-fire rated corridor.

Additionally, the fabric fire door may be used as an alternative to the requirement for an enclosed elevator lobby in accordance with 2012 IBC Section 713.14.1, 2009 IBC Section 708.14.1 and 2006 IBC Section 707.14.1, all incorporated by reference, when installed remotely from elevator openings at the intersection of the elevator lobby and a fire rated corridor.

The fabric fire door may also be used as a smoke barrier when an elevator lobby is used as an area of refuge in accordance with 2012, 2009 and 2006 IBC Section 1007.6, all incorporated by reference.

Furthermore, the fabric fire door may also be used as an alternative to the smoke and draft control doors required by 2012 IBC Section 710.5.2.2, 2009 IBC Section 711.5.22006 IBC Section 710.5.2, all incorporated by reference.

The fire and smoke rated fabric door has demonstrated a fire-resistance rating of about 60 minutes for openings in approved construction up to about 12 feet wide by about 11 feet 6 inches tall (about 3657.6 mm×about 3505.2 mm) and up to about 138 square feet (about 12.82 $m^2$) in area. The door complies as a smoke- and draft-control assembly in accordance with 2012 IBC Section 716.5.3, 2009 IBC Section 715.4.3 and 2006 IBC Section 715.4.3, all incorporated by reference.

The fire and smoke rated fabric door is applicable for use in shaft enclosures in accordance with 2012 IBC Section 713.7, 2009 IBC Section 708.7 and 2006 IBC Section 708.6; for use in smoke barrier walls in accordance with 2012 IBC Section 709.5, 2009 IBC Section 710.5 and 2006 IBC Section 709.5; and for use in smoke partition walls in accordance with 2012 IBC Section 710.5, 2009 IBC Section 711.5 and 2006 IBC Section 710.5, all incorporated by reference.

Such configurations allow building designers the ability to reduce the construction costs and aesthetic problems associated with conventional fire/emergency egress doors.

Yet another advantage is the ability to obtain a 60 minute, non-hose stream fire rating.

Another advantage is the ability to allow manual egress of the entire width of the curtain in the vertical direction.

Still another advantage is the ability of side guide rails to match up cleanly with either elevator hoistway framing or for FOW or BJ guides for elevator lobby or cross corridor openings.

Yet another advantage is the elimination of side-hinged swing door mullions and header construction, thereby allowing for unobstructed paths of egress.

When compared to pocket width requirements for horizontal sliding egress fire doors and head room requirements for rolling doors with attached side-hinged swinging doors, the door requires minimal head and side room clearances.

Still another advantage is that the door can remain fully out of egress paths during normal conditions, thereby providing fewer tendencies with which to be tampered.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

Figure 1B:
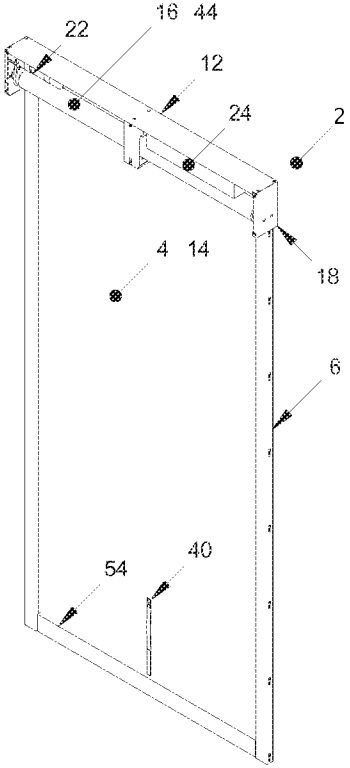
FIG. 1*b* is a perspective view of the fire and smoke rated fabric door.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessary to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention.

For purposes of this disclosure, the term "fabric" is meant to include any material capable of achieving a curtain requiring no more than codified emergency egress requirements of lifting force as described below.

Turning to the figures, the fire and smoke rated fabric door 2 is a vertically coiling smoke and fire containment system that is comprised of a fire resistant curtain 4, for example, a silica fabric curtain, vertically oriented side members 6, for example, vertical steel guide rails, a counterbalance assembly 8 and an operational assembly 10. The counterbalance assembly 8 and operational assembly 10 are preferably contained within an overhead coil box 12. The curtain 4 is, for example, a 2.5-mil-thick silica cloth curtain coated with a urethane based resin on one side with panels 14 stitched together horizontally with twisted stainless steel threads.

The counterbalance assembly 8 comprises a counterbalance barrel 16, for example, a shaft, which is supported above the opening and secured at each end by a securing member 18, for example, a bracket or end plate. The curtain 4 directly attaches to the shaft 16 and rolls onto and off of the shaft 16 as the shaft is rotated by the operational assembly 10. The curtain travels within the vertically oriented side members 6, within which the outer edges 20 of the curtain are contained and guided. In a preferred embodiment, each curtain outer edge 20 comprises a side geometry which is mechanically locked within the vertically oriented side member 6.

Figure 2:
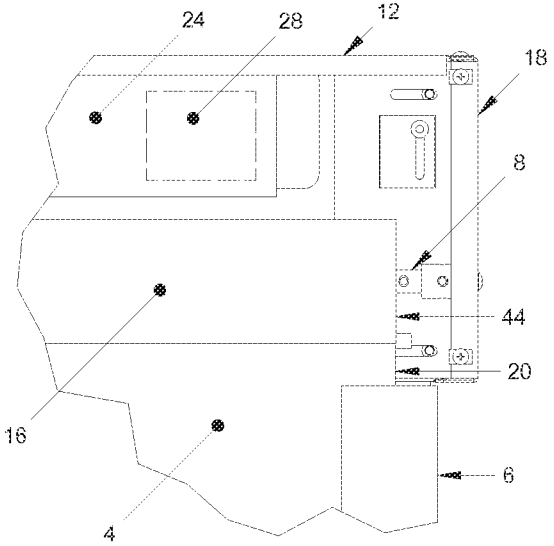
FIG. 2 is a front view of a first end of the counter balance assembly.
Figure 3:
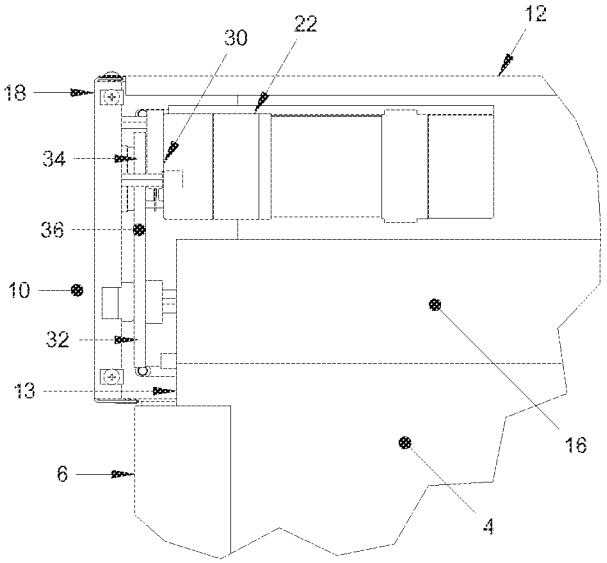
FIG. 3 is a front view of the operational assembly.
Figure 4:
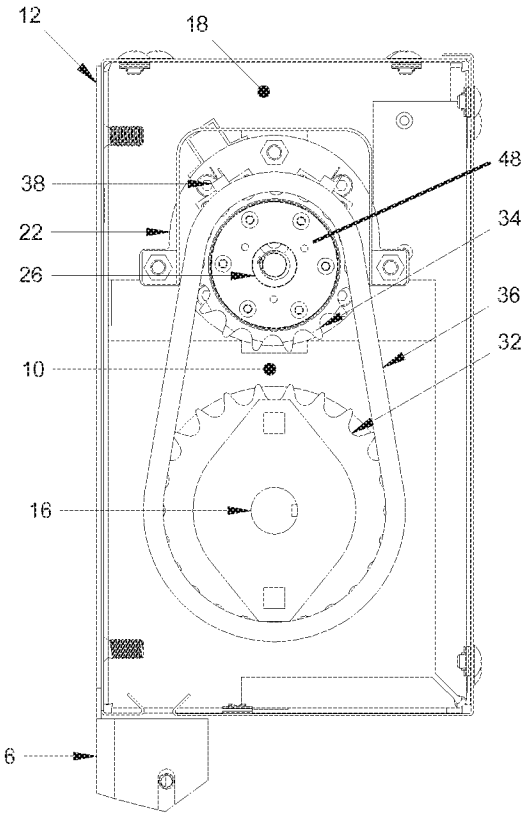
FIG. 4 is an end view of the operational assembly.

The operational assembly 10 (FIG. 4) comprises, for example, an electrically powered operating system comprising a fire door operator 22 comprising a controller 24 (FIG. 2), releasing device 26, continuously charged battery backup power supply 28 and a drive motor assembly 30 (FIG. 3). The counter balance barrel 16 is driven by, for example, a barrel sprocket 32 connected to a motor drive sprocket 34 with a roller chain 36 that rotates the barrel 16 to coil and un-coil the curtain 4.

The operational assembly 10 is designed to function under normal or test conditions with a secured or unsecured Open/Close/Stop station. The controller 24 is programmed to automatically deploy the curtain 4 upon entering an alarm condition, for example, receiving notification from a building fire alarm control panel, local fire and/or smoke detection appliances, or upon a pre-determined reduction of available power, for example, DC battery power.

Upon notification, the operator 22 will delay release of the curtain 4 for a predetermined time period, for example, about ten seconds, and then release the releasing device 26, for example, a holding brake, activating the curtain 4 to deploy by gravity at a predetermined rate, for example, to between about 6" and about 24" per second, per NFPA 80, incorporated by reference.

Figure 5:
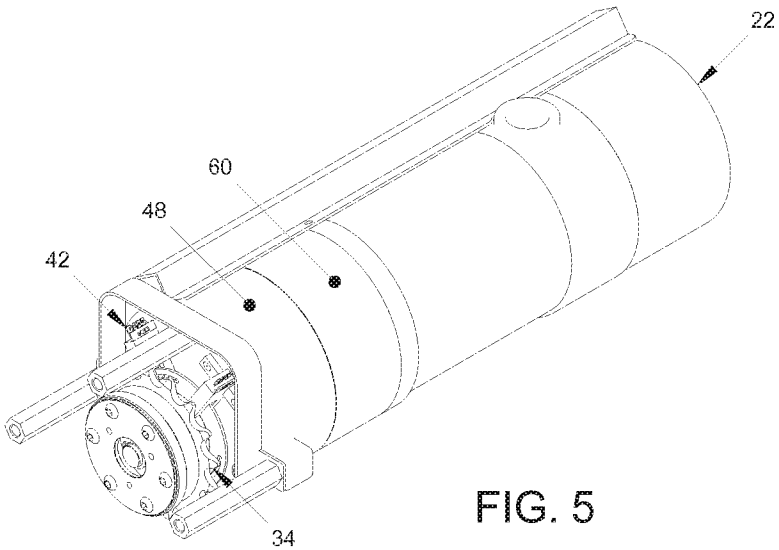
FIG. 5 is a perspective view of the operator.

If the curtain 4 encounters an obstruction (not shown) the curtain 4 stops and rests at the obstruction. Once the obstruction is removed, the descent to full closure will continue by gravity. When the bottom edge of the curtain (bottom bar 52, FIG. 7) contacts an obstruction, the curtain 4 will stop moving, even though the operator 22 may still be turning. This is made possible by the ratcheting assembly 48, described further below. Once the curtain 4 stops moving, the rotation sensor 42 (FIG. 5) will take notice and apply the brake 60. Thus the ratcheting assembly 48 and rotation sensor 42 work together to act as an obstruction sensor, thereby eliminating the need for a separate obstruction sensor. While not required, an optional separate obstruction sensor 38 (FIG. 7*b*) in operative connection with the operational assembly 10 may be added as a secondary sensor.

Figure 1A:
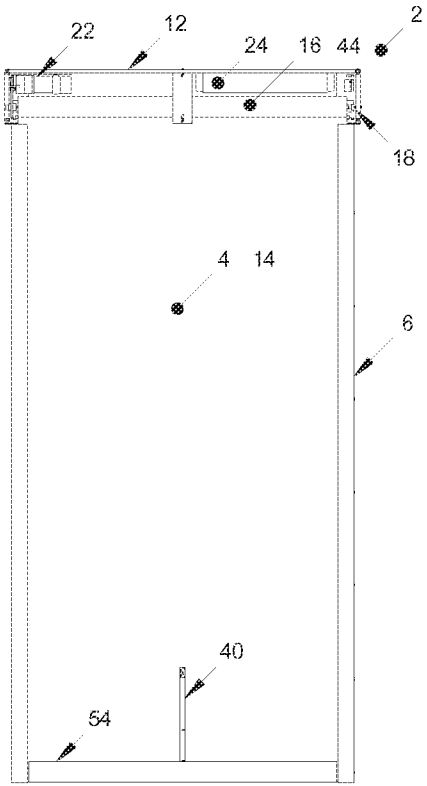
FIG. 1*a* is a front view of the fire and smoke rated fabric door.

Occupants requiring emergency egress can lift the curtain 4 at any time and from any position with an integral handle 40 (FIGS. 1*a* and 1*b*) requiring, for example, less than about 15 pounds of upward lifting force. About 8" to about 12" of upward curtain movement will trigger the operational assembly 10 to electrically engage and open the curtain 4 to a predetermined minimum escapement area, for example, about 88 square inches, per NFPA 101, incorporated by reference.

Ideally, the activation of egress must be easily understandable and achievable during emergency condition. To address these concerns, a power egress and a manual egress feature are activated in the same manner, for example, by grabbing the handle 40 and lifting in the vertical direction. Shown in FIG. 5, at least one rotation sensor 42 that detects rotation and direction is installed on the operational assembly 10.

Logic is written into the controller 24 that activates power egress once upward motion is detected. Thus, if power is available, once an individual grabs the curtain handle 40 and begins to lift the curtain 4, the operator motor will take over, raise the curtain 4 to a predetermined height, pause for a predetermined duration, and then allow the curtain 4 to close. If no power is available, the individual grabs the curtain handle 40 and lifts the curtain 4 in the same manner, only without assistance of the drive motor assembly 30. Known metal coiling doors are too heavy to be lifted manually during an alarm condition.

During an alarm condition, if the curtain 4 billows it is possible that the billowing could cause the barrel 16 to rotate, thereby unintentionally activating the power egress and resulting in an unwanted door opening. This unwanted door opening could allow smoke and fire to pass whenever the door area experienced a significant change in pressure. To prevent this problem, logic is incorporated into the operational assembly 10 that factors the rotational direction and travel distance determined by the rotation sensor 42 to determine whether the motion is caused by a pressure difference or an individual trying to activate the egress feature.

The curtain 4 is counter balanced so that it gravity closes from any position, yet may be manually lifted to a specified egress height with a predetermined emergency egress lifting force, for example, less than about 15 pounds of lifting force. In a preferred embodiment, to achieve this balance for larger sized units, a torsion spring 44 is selected for each curtain 4 so that it balances the unit within the aforementioned guidelines.

Figure 6:
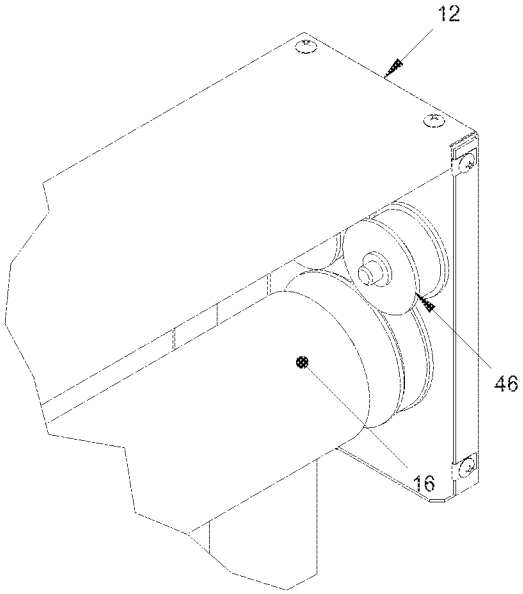
FIG. 6 is a perspective view of the constant torque springs.

When the curtain 4 is fabricated from material that is light and thin, standard torsion springs may not achieve the balance required for such smaller units. A counterweight system would be effective in this situation, but is not optimal due to size constraints. Optimally, as shown in FIG. 6, a spring motor 46 comprised of, for example, a combination of constant torque springs, are arranged into and used to balance the curtain 4. The type of spring used is dependent on the size of the unit and material selected.

Once lifted, the curtain 4 will then re-deploy to a fully closed position after a predetermined time period, for example, about a ten second delay, as long as there remains an alarm condition notification. Once the alarm condition clears and power is restored, the curtain 4 will automatically retract to a fully open position.

Because the curtain 4 needs to be manually egressed with the predetermined emergency egress lifting force, for example, less than about 15 pounds of lifting force, and still gravity close from all positions, any added resistance to the operation of the curtain 4 makes obtaining this balance difficult. One major obstacle is having to backdrive through the operator 22 when moving the curtain 4. Failing to achieve the required balance may cause the curtain 4 to be too heavy to open (requiring greater than the emergency egress lifting force) or result in the curtain 4 not fully closing under an alarm condition.

To avoid having to backdrive through the operator 22, a ratcheting assembly 48 is incorporated into the drive motor assembly 30 (FIG. 3). When manually opening the curtain 4 via the handle 40, the ratcheting assembly 48 allows the barrel 16 to rotate without having to rotate the operator 22. When the curtain 4 is closing, the ratcheting assembly 48 engages the operator 22 in order to utilize its governing feature.

The door 2 includes a back-up power supply 28, for example, battery back-up protection, and is designed to function fully as described above by back-up power during an interruption of the primary power supply. The door 2 will not activate to close during a primary power interruption unless an alarm condition notification is received, or until back-up power is reduced to a pre-determined level, at which time the curtain 4 will activate to deploy as described.

In the event that the back-up power supply 28 becomes discharged below a predefined power level, the curtain 4 will activate and deploy to the fully closed position by gravity. In any of the events described above, the curtain 4 remains capable of being manually lifted to any height with a force less than the emergency egress lifting force.

Because the door 2 is balanced to require only the emergency egress lifting force to open, the curtain 4 is susceptible to lifting and formation of a leakage gap 58 (FIG. 7) between the curtain 4 and the floor 50 when pressure is applied to the curtain 4. The leakage gap 58 formed along the bottom edge of the opening would reduce the effectiveness in retarding the spread of smoke and fire in an alarm condition.

Figures 7A, 7B:
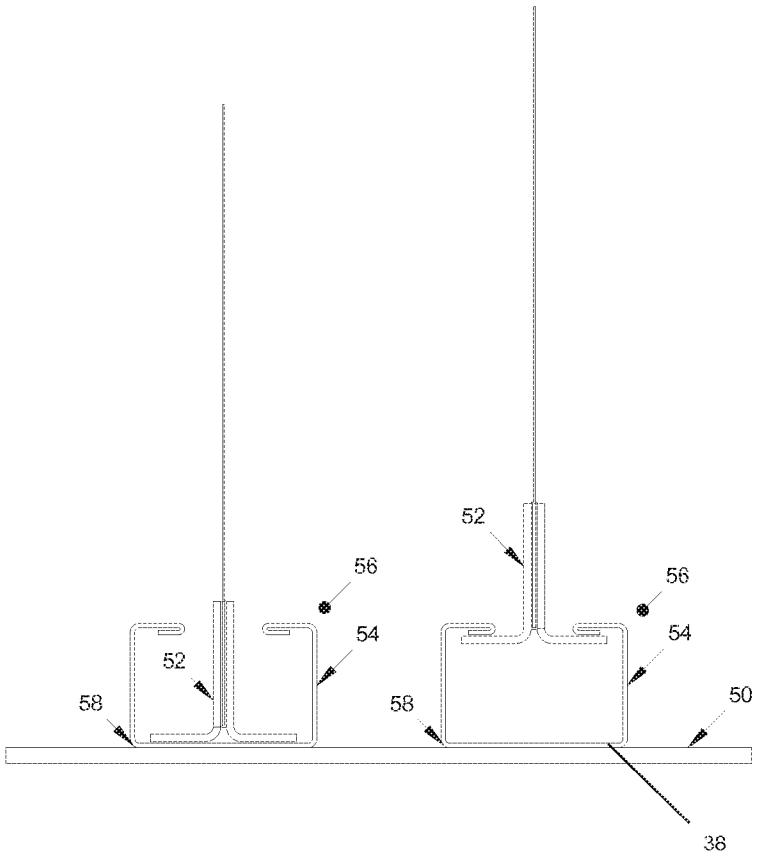
FIGS. 7*a* and 7*b* are a side views of a collapsible bottom bar profile.

Shown in FIGS. 7*a* and 7*b*, to solve this problem, a collapsible bottom bar profile 56 is provided. A floating bumper 54 is installed onto the bottom bar profile 52. Upon contacting the floor 50, the floating bumper 54 collapses on the bottom bar 52. When effective pressure is applied to the curtain 4 to cause the bottom bar 52 to lift off of the floor 50, the design allows the bottom bar 52 to lift without lifting the floating bumper 54, thus maintaining an effective seal with the floor 50.

A closing curtain without obstruction sensing equipment, even a lightweight slow-moving one such as the presently described fire and smoke rated fabric door, has the potential to make emergency egress more difficult. For example, if the curtain begins closing while individuals are still attempting to move through the opening, the curtain would require someone to hold it in an open position to maintain the egress opening until all individuals are cleared.

To overcome this problem the rotation sensor 42 distinguishes when the curtain 4 reaches the closed position or a predetermined down limit by sensing that the barrel 16 has stopped rotating for a predetermined duration of time, for example, about 1-2 seconds, whereupon a releasing device, for example, brake 60 is engaged. The brake 26 is held for a predetermined duration of time, for example, about 10 seconds, then the brake 60 is released to check and insure the down limit has been reached. It the barrel 16 does not rotate, the brake 60 is reengaged. If the barrel 16 does rotate, the operational assembly 10 allows the barrel 16 to continue rotating until it senses the barrel 16 has once again stopped rotation, for example, stoppage of about 1-2 seconds. This cycle is continued until confirmation is made that the down limit has been reached. In a preferred embodiment the confirmatory cycle is repeated 3 times.

Although the present invention has been described in connection with specific examples and embodiments, those skilled in the art will recognize that the present invention is capable of other variations and modifications within its scope. For example, while a maximum lifting force of about 15 lbs. has been described, any lifting force that meets codified emergency egress requirements is contemplated.

These examples and embodiments are intended as typical of, rather than in any way limiting on, the scope of the present invention as presented in the appended claims.

What is claimed is:

1. An overhead coiling door system comprising:

a vertically coiling curtain operatively contained within vertically oriented side members and operatively connected to a counterbalance assembly and an operational assembly; wherein the counterbalance assembly comprises a counterbalance barrel supported at each end by a securing member;

the operational assembly comprises a powered operating system comprising an operator comprising a controller, releasing device, continuously charged backup power supply and drive motor assembly;

release of the door is delayed for a first predetermined period of time upon receiving notice of a predefined emergency alarm condition;

the releasing device is released after the first predetermined period of time allowing the door to deploy by gravity at a predetermined rate;

the gravity deployment is stopped upon door contact with an obstruction;

gravity deployment is continued at the predetermined rate upon removal of the obstruction;

the door is capable of being lifted without power at any time with less than a predefined amount of emergency egress lifting force and after the door is lifted a predetermined amount a power engagement is triggered to power move the door to a predetermined minimum escapement area;

the door is paused at the predetermined minimum escapement area for a second predetermined period of time; and the door is allowed to once again deploy by gravity at the predetermined rate after the second predetermined period of time; and lifting capability of the door without power with less than a predefined amount of emergency egress lifting force is available at any time upon loss of the operating power, with resumption of gravity deployment at the predetermined rate upon removal of the emergency egress lifting force.

2. An overhead coiling door system comprising:

a vertically coiling curtain operatively contained within vertically oriented side members and operatively connected to a counterbalance assembly and an operational assembly;

a ratcheting assembly operatively connected to a drive motor assembly; and a rotation sensor operatively connected to a releasing device;

wherein the counterbalance assembly comprises a counterbalance barrel supported at each end by a securing member;

the operational assembly comprises a powered operating system comprising an operator comprising a controller, the releasing device, continuously charged backup power supply and the drive motor assembly;

the curtain comprises a handle capable of lifting with no more than a predetermined emergency egress requirement of upward lifting force to create a predefined minimum escapement area;

the counterbalance assembly and operational assembly are contained within an overhead coil box;

the curtain comprises a fires resistant material; a first and second outer edge, each outer edge comprising a side geometry mechanically locked within the vertically oriented side members; and a curtain bottom edge comprising a collapsible bottom bar profile;

the counterbalance barrel is driven by a barrel sprocket operatively connected to a motor drive sprocket through a roller chain;

release of the door is delayed for a first predetermined period of time upon receiving notice of a predefined emergency alarm condition;

the releasing device is released after the first predetermined period of time allowing the door to deploy by gravity at a predetermined rate;

the gravity deployment is stopped upon door contact with an obstruction;

gravity deployment is continued at the predetermined rate upon removal of the obstruction;

the door is capable of being lifted without power at any time with less than a predefined amount of emergency egress lifting force and after the door is lifted a predetermined amount a power engagement is triggered to power move the door to a predetermined minimum escapement area;

the door is paused at the predetermined minimum escapement area for a second predetermined period of time; and the door is allowed to once again deploy by gravity at the predetermined rate after the second predetermined period of time; and lifting capability of the door without power with less than a predefined amount of emergency egress lifting force is available at any time upon loss of the operating power, with resumption of gravity deployment at the predetermined rate upon removal of the emergency egress lifting force.

3. A method of providing overhead coiling door emergency egress comprising the steps of:

Delaying for a first predetermined period of time release of a door upon receiving notice of a predefined emergency alarm condition;

releasing a releasing device after the first predetermined period of time allowing the door to deploy by gravity at a predetermined rate;

stopping the gravity deployment upon door contact with an obstruction;

continuing gravity deployment at the predetermined rate upon removal of the obstruction;

lifting the door without power at any time with less than a predefined amount of emergency egress lifting force and after the door is lifted a predetermined amount triggering a power engagement to power move the door to a predetermined minimum escapement area;

pausing the door at the predetermined minimum escapement area for a second predetermined period of time; and allowing the door to once again deploy by gravity at the predetermined rate after the second predetermined period of time; and providing lifting capability of the door without power at any time with less than a predefined amount of emergency egress lifting force upon loss of the operating power, with resumption of gravity deployment at the predetermined rate upon removal of the emergency egress lifting force.

4. The method of claim 3 further comprising the step of deploying the door to a predetermined position once the predefined emergency alarm condition ends.

5. The method of claim 3 wherein the door comprises:

a vertically coiling curtain operatively contained within vertically oriented side members and operatively connected to a counterbalance assembly and an operational assembly; wherein the counterbalance assembly comprises a counterbalance barrel supported at each end by a securing member;

the operational assembly comprises a powered operating system comprising an operator comprising a controller, releasing device, continuously charged backup power supply and drive motor assembly;

the controller automatically deploys the curtain upon entering an alarm condition to delay release for a predetermined time period and then release the releasing device activating the curtain to gravity deploy at a predetermined rate governed by the system, the curtain stopping its deployment upon encountering an obstruction and redeploying once the obstruction is removed; and the curtain comprises a handle capable of lifting with no more than a predetermined emergency egress requirement of upward lifting force to create a predefined minimum escapement area.

6. The method of claim 5 wherein the curtain is fire resistant and the counterbalance assembly and operational assembly are contained within an overhead coil box.

7. The method of claim 5 wherein the curtain comprises a first and second outer edge, each outer edge comprising a side geometry creating a mechanical lock within the vertically oriented side members.

8. The method of claim 5 wherein the counterbalance barrel is driven by a barrel sprocket operatively connected to a motor drive sprocket through a roller chain.

9. The method of claim 5 wherein the releasing device is a holding brake.

10. The method of claim 5 wherein the counterbalance assembly further comprises a torsion spring operatively connected to the counterbalance barrel.

11. The method of claim 5 wherein the counterbalance assembly further comprises a spring motor comprised of constant torque springs operatively connected to the counterbalance barrel.

12. The method of claim 5 wherein a curtain bottom edge comprises a collapsible bottom bar profile.

13. The method of claim 12 further comprising the step of deploying the door to a predetermined position once the predefined emergency alarm condition ends.

14. The method of claim 12 wherein the collapsible bottom bar profile comprises a floating bumper collapsibly attached to a bottom bar.

15. The method of claim 3 wherein the door comprises:

a vertically coiling curtain operatively contained within vertically oriented side members and operatively connected to a counterbalance assembly and an operational assembly;

a ratcheting assembly operatively connected to a drive motor assembly; and a rotation sensor operatively connected to the releasing device;

wherein the counterbalance assembly comprises a counterbalance barrel supported at each end by a securing member;

the operational assembly comprises a powered operating system comprising an operator comprising a controller, the releasing device, continuously charged backup power supply and the drive motor assembly;

the controller automatically deploys the curtain upon entering the alarm condition to delay release for the first predetermined time period and then release the releasing device activating the curtain to gravity deploy at a predetermined rate governed by the system, the curtain stopping its deployment upon encountering an obstruction and redeploying once the obstruction is removed; and the curtain comprises a handle capable of lifting with no more than a predetermined emergency egress requirement of upward lifting force to create the predefined minimum escapement area;

the counterbalance assembly and operational assembly are contained within an overhead coil box;

the curtain comprises a fire resistant material; a first and second outer edge, each outer edge comprising a side geometry creating a mechanical lock within the vertically oriented side members; and a curtain bottom edge comprising a collapsible bottom bar profile; and the counterbalance barrel is driven by a barrel sprocket operatively connected to a motor drive sprocket through a roller chain.

16. The method of claim 15 wherein the counterbalance assembly further comprises a spring motor comprised of constant torque springs operatively connected to the counterbalance barrel.

17. The method of claim 15 further comprising a control for opening, closing, and stopping the door, operatively connected to the operational assembly.

18. The method of claim 15 wherein the collapsible bottom bar profile comprises a floating bumper collapsibly attached to a bottom bar.

19. The method of claim 18 further comprising the step of deploying the door to a predetermined position once the predefined emergency alarm condition ends.

20. The method of claim 15 wherein the releasing device is a holding brake.

21. The method of claim 15 wherein the counterbalance assembly further comprises a torsion spring operatively connected to the counterbalance barrel.

* * * * *